US008876248B2

(12) United States Patent
Huang et al.

(10) Patent No.: US 8,876,248 B2
(45) Date of Patent: Nov. 4, 2014

(54) DETECTING METHOD FOR PRINTING MATERIAL BOUNDARY OF LARGE UV INKJET PRINTER

(71) Applicant: Great Computer Corporation, New Taipei (TW)

(72) Inventors: Chih-Chiang Huang, New Taipei (TW); Chi-Hua Yen, New Taipei (TW); Liang Shih, New Taipei (TW)

(73) Assignee: Great Computer Corporation, New Taipei (TW)

( * ) Notice: Subject to any disclaimer, the term of this patent is extended or adjusted under 35 U.S.C. 154(b) by 45 days.

(21) Appl. No.: 13/846,363

(22) Filed: Mar. 18, 2013

(65) Prior Publication Data

US 2014/0267489 A1 Sep. 18, 2014

(51) Int. Cl.
*B41J 29/393* (2006.01)
*B41J 13/26* (2006.01)

(52) U.S. Cl.
CPC ..... *B41J 13/26* (2013.01)
USPC ..... 347/19; 347/14

(58) Field of Classification Search
USPC ..... 347/14, 16, 19, 104–106
See application file for complete search history.

(56) References Cited

U.S. PATENT DOCUMENTS 6,499,822 B1 * 12/2002 Abe et al. ..... 347/19

* cited by examiner

*Primary Examiner* — Juanita D Jackson
(74) *Attorney, Agent, or Firm* — Muncy, Geissler, Olds & Lowe, P.C.

(57) ABSTRACT

A detecting method for printing material boundary of a large UV inkjet printer includes steps of performing a full-field scanning process at a first scanning speed by a photosensitive element disposed on an inkjet module to cause a sensing device to produce induced voltage signals corresponding to different positions below sequentially in order to determine rough coordinate positions of two opposite sides of the printing material based on the changes of the induced voltage signals, and to define detailed scanning areas including the rough coordinate positions of the two opposite sides; and performing a detailed scanning process for the detailed scanning areas along an opposite direction at a second scanning speed slower than the first scanning speed by the photosensitive element in order to obtain boundary coordinate positions of the two opposite sides of the printing material based on the changes of the induced voltage signals.

6 Claims, 1 Drawing Sheet

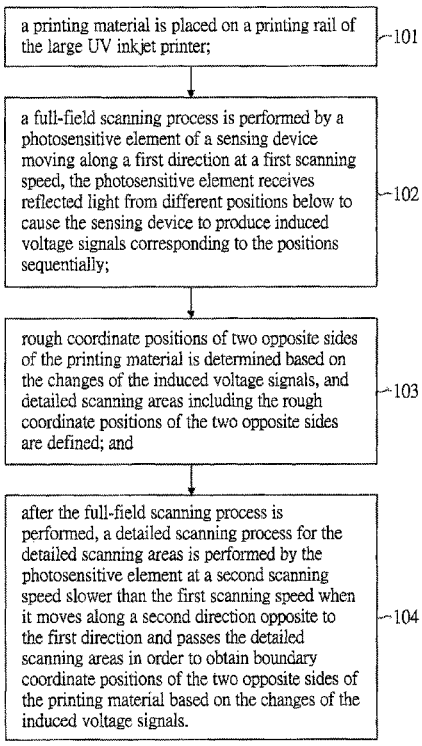

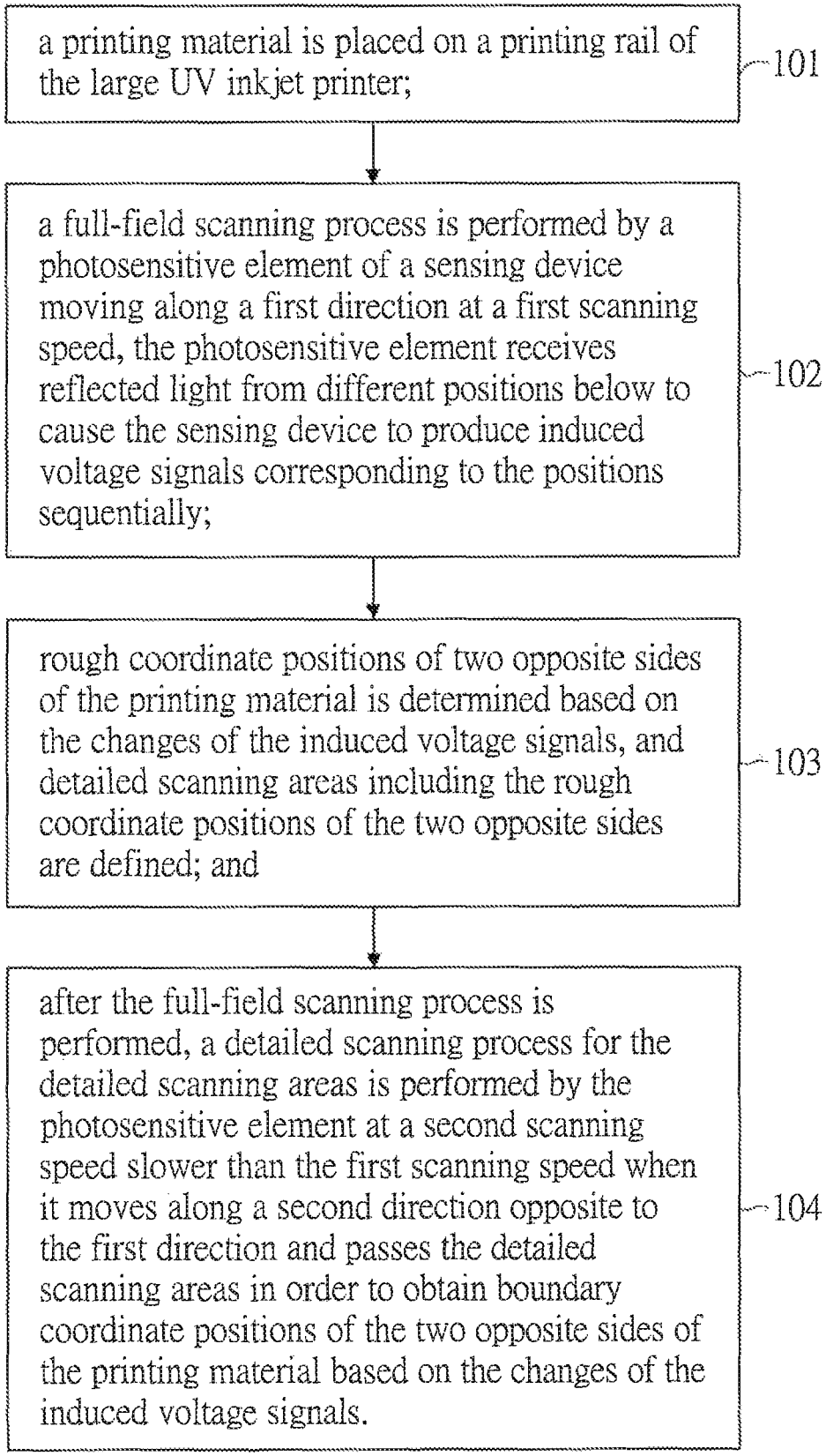
a printing material is placed on a printing rail of the large UV inkjet printer;
101
a full-field scanning process is performed by a photosensitive element of a sensing device moving along a first direction at a first scanning speed, the photosensitive element receives reflected light from different positions below to cause the sensing device to produce induced voltage signals corresponding to the positions sequentially;
102
rough coordinate positions of two opposite sides of the printing material is determined based on the changes of the induced voltage signals, and detailed scanning areas including the rough coordinate positions of the two opposite sides are defined; and
103
after the full-field scanning process is performed, a detailed scanning process for the detailed scanning areas is performed by the photosensitive element at a second scanning speed slower than the first scanning speed when it moves along a second direction opposite to the first direction and passes the detailed scanning areas in order to obtain boundary coordinate positions of the two opposite sides of the printing material based on the changes of the induced voltage signals.
104

DETECTING METHOD FOR PRINTING MATERIAL BOUNDARY OF LARGE UV INKJET PRINTER

BACKGROUND OF THE INVENTION

1. Field of Invention

The present invention relates to a detecting method for printing material boundary of a large UV inkjet printer and more particularly to a method for determining boundary coordinate positions of two opposite sides of the printing material by double detecting changes of induced voltage signals of a sensing device.

2. Related Art

Large UV inkjet printer can be used for printing on to-be-printed objects of different materials and thicknesses, besides that its printing speed is faster and the printing quality is more stable and consistent, work and time for making halftone can also be saved for users due to its dependable efficiency in order that printing can be done speedily. Therefore, large UV inkjet printer has become competitive in the market by providing various economical and practical solutions for printing.

Before a large UV inkjet printer prints on a printing material, it has to locate the position of the printing material and to detect the width of the printing material first, in order to determine the corresponding positions of the to-be-printed patterns and the printing material before printing.

However, there are many types of printing materials with different colors and thicknesses, and the conditions of reflecting and absorbing light for the same printing material surface are not consistent. In addition, during the detection of a printing material boundary, environmental lighting will have effects on the accuracy of the detection. Therefore, conventional detecting processes for printing material boundary are only suitable for using with specific colors, thicknesses and types of printing materials. When the height of a sensor has to be elevated for a thicker printing material, the accuracy of detection of the sensor will be reduced because of the effects of environmental lighting or the uneven transmittance of the printing material.

SUMMARY OF THE INVENTION

In view of the above problems and in order that a detecting method for printing material boundary of a large UV inkjet printer of the present invention can be suitable for using in detecting boundary of most printing materials, the interference conditions of detecting signals of a sensing device is determined and corrected dynamically for different types, thicknesses and colors of printing materials.

A primary objective of the present invention is to provide a detecting method for printing material boundary of a large UV inkjet printer. The detecting method defines detailed scanning areas including two opposite sides of a printing material based on the changes of induced voltage signals when a full-field scanning process is performed by a sensing device. Then, a detailed scanning process is performed on the detailed scanning areas in order to obtain boundary coordinate positions of the two opposite sides of the printing material based on the changes of the induced voltage signals.

In order to achieve the above-mentioned objectives, a detecting method for printing material boundary of a large UV inkjet printer of the present invention includes steps of:

a printing material is placed on a printing rail of the large UV inkjet printer;

a full-field scanning process is performed by a photosensitive element of a sensing device moving along a first direction at a first scanning speed, the photosensitive element receives reflected light from different positions below to cause the sensing device to produce induced voltage signals corresponding to the positions sequentially;

rough coordinate positions of two opposite sides of the printing material is determined based on the changes of the induced voltage signals, and detailed scanning areas including the rough coordinate positions of the two opposite sides are defined; and after the full-field scanning process is performed, a detailed scanning process for the detailed scanning areas is performed by the photosensitive element at a second scanning speed slower than the first scanning speed when it moves along a second direction opposite to the first direction and passes the detailed scanning areas in order to obtain boundary coordinate positions of the two opposite sides of the printing material based on the changes of the induced voltage signals.

The detecting method for printing material boundary of a large UV inkjet printer of the present invention can accurately detect boundary positions and width of to-be-printed objects of different materials in different interference conditions by determining intensity levels of induced voltage signals dynamically.

The present invention will become more fully understood by reference to the following detailed description thereof when read in conjunction with the attached drawings.

BRIEF DESCRIPTION OF THE DRAWINGS

FIG. 1 is a flow chart of a detecting method for printing material boundary of a large UV inkjet printer according to an embodiment of the disclosure.

DETAILED DESCRIPTION OF THE INVENTION

Please refer to FIG. 1, which is a flow chart of a detecting method for printing material boundary of a large UV inkjet printer of the present invention. The detecting method for printing material boundary of a large UV inkjet printer includes steps of:

step 101: a printing material is placed on a printing rail of the large UV inkjet printer;

step 102: a full-field scanning process is performed by a photosensitive element of a sensing device moving along a first direction at a first scanning speed, the photosensitive element receives reflected light from different positions below to cause the sensing device to produce induced voltage signals corresponding to the positions sequentially;

step 103: rough coordinate positions of two opposite sides of the printing material is determined based on the changes of the induced voltage signals, and detailed scanning areas including the rough coordinate positions of the two opposite sides are defined; and step 104: after the full-field scanning process is performed, a detailed scanning process for the detailed scanning areas is performed by the photosensitive element at a second scanning speed slower than the first scanning speed when it moves along a second direction opposite to the first direction and passes the detailed scanning areas in order to obtain boundary coordinate positions of the two opposite sides of the printing material based on the changes of the induced voltage signals.

An inkjet module installed on the large UV inkjet printer can be moved along a sliding rail traversely and vertically above the printing material on the printing rail to print patterns. Bottom plates are disposed vertically by two sides of the printing rail of the large UV inkjet printer and are disposed below the sliding rail of the inkjet module.

The sensing device includes the photosensitive element, an analog-to-digital converter, a comparator and a driving module for driving the photosensitive element. The photosensitive element is disposed on the inkjet module installed on the large UV inkjet printer. The photosensitive element receives reflected light of different intensities based on different conditions and converts the reflected light into different analog voltage signals. The analog-to-digital converter is used for retrieving the analog voltage signals produced by the photosensitive element after receiving the reflected light, and converting the analog voltage signals into digital voltage signals. The comparator is used for comparing voltage values of the digital voltage signals with a threshold value, producing an induced voltage signal based on the comparing results and transmitting the induced voltage signal to a controller host. The controller host includes a programmable logic element and a controlling unit. The programmable logic element is used for receiving the induced voltage signal from the comparator and transmitting the induced voltage signal to the controlling unit in order that the controlling unit obtains actual coordinate positions of the two opposite sides of the printing material based on the changes of the induced voltage signal and calculates boundary positions and width of the printing material. The controlling unit is used for sending commands to the driving module and the inkjet module through the programmable logic element in order to drive the inkjet module and the sensing device.

When the detecting method for printing material boundary of a large UV inkjet printer is embodied, the printing material is paced on the printing rail and the printing rail is moved to a position below the sliding rail of a printing module. Then, the controlling unit sends commands to the inkjet module and the photosensitive element through the programmable logic element of, for example, a field programmable gate array (FPGA) to cause the inkjet module to move along the first direction towards another end of the sliding rail at the first scanning speed, and causes the sensing device to perform the full-field scanning process in order that the photosensitive element receives the light reflected by the bottom plates and the printing material below sequentially and converts the received light into the analog voltage signals sequentially.

At the same time when the full-field scanning process is performed, the analog-to-digital converter retrieves the analog voltage signals produced by the photosensitive element sequentially and converts the analog voltage signals into the digital voltage signals. The comparator produces the induced voltage signals sequentially and transmits the induced voltage signals to the controlling unit sequentially through the programmable logic element. During the full-field scanning process, when the photosensitive element passes a side of the printing material and receives the reflected light of the printing material, the comparator produces the induced voltage signals with higher voltage values by using the voltage values of the analog voltage signals produced by the photosensitive element based on the reflected light of the bottom plates as the threshold values until the photosensitive element passes another side of the printing material. The photosensitive element receives the light reflected by the bottom plates again after passing the printing material which causes the comparator to produce the induced voltage signals with the same voltage values as the reference voltage values. Thereby, when the controlling unit receives the induced voltage signals with higher voltage values the first time, the rough coordinate positions of the first side of the printing material are determined based on the position of the photosensitive element, and the rough coordinate positions of the second side of the printing material are determined based on the position of the photosensitive element when the induced voltage signals with the same voltage values as the reference voltage values are received again, in order that a first detailed scanning area including the rough coordinate positions of the first side and a second detailed scanning area including the rough coordinate positions of the second side are defined.

After the full-field scanning process is performed, the controlling unit causes the photosensitive element to move along the second direction opposite to the first direction to perform the detailed scanning process for the two detailed scanning areas sequentially at the second scanning speed slower than the first scanning speed when the photosensitive element passes the second detailed scanning area and the first detailed scanning area. Thereby, during the detailed scanning process, when the controlling unit receives the induced voltage signals with higher voltage values the first time, the boundary coordinate positions of the second side of the printing material are determined based on the position of the photosensitive element, and the boundary coordinate positions of the first side of the printing material are determined based on the position of the photosensitive element when the induced voltage signals with the same voltage values as the reference voltage values are received again. Therefore, after the detailed scanning process is performed by the controlling unit, the boundary positions and the width of the printing material can be obtained by calculation based on the boundary coordinate positions of the first and second sides in order to perform subsequent pattern printing process accurately. The embodiments described above are only used as examples for explaining the disclosure, but should not be construed as limitations to the disclosure thereof.

The present invention can solve the problem of unable to detect boundary of printing materials inaccurately by large conventional UV inkjet printer which can be easily interfered by external environments and materials of to-be-printed objects. Therefore, boundary positions of to-be-printed objects made of different materials and with different widths can be detected by large UV inkjet printer in order that to-be-printed patterns can be printed on printing materials accurately, and production efficiency of large UV inkjet printer can be enhanced.

As a conclusion from the above disclosed contents, the present invention can achieve the expected objectives by causing the photosensitive element to perform the detailed scanning and detection for the boundary positions of the printing material twice along the moving direction of the inkjet module, in order that the boundary coordinate positions of the two opposite sides of the printing material can be obtained by detecting the changes of the induced voltage signals, and to-be-printed patterns can be printed on printing material accurately.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A detecting method for printing material boundary of a large UV inkjet printer, comprising steps of:

placing a printing material on a printing rail of the large UV inkjet printer;

performing a full-field scanning process by a photosensitive element of a sensing device moving along a first direction at a first scanning speed, the photosensitive element receiving reflected light from different positions below to cause the sensing device to produce corresponding induced voltage signals sequentially;

determining rough coordinate positions of two opposite sides of the printing material based on the changes of the induced voltage signals, and defining detailed scanning areas including the rough coordinate positions of the two opposite sides; and after performing the full-field scanning process, performing a detailed scanning process for the detailed scanning areas by the photosensitive element at a second scanning speed slower than the first scanning speed when the photosensitive element moving along a second direction opposite to the first direction and passing the detailed scanning areas in order to obtain boundary coordinate positions of the two opposite sides of the printing material based on the changes of the induced voltage signals.

2. The detecting method for printing material boundary of the large UV inkjet printer as claimed in claim 1, wherein the sensing device comprises an analog-to-digital converter used for retrieving analog voltage signals produced by the photosensitive element after receiving the reflected light, and converting the analog voltage signals into digital voltage signals.

3. The detecting method for printing material boundary of the large UV inkjet printer as claimed in claim 2, wherein the sensing device comprises a comparator used for comparing voltage values of the digital voltage signals with a threshold value, producing an induced voltage signal based on the comparing results and transmitting the induced voltage signal to a controller host.

4. The detecting method for printing material boundary of the large UV inkjet printer as claimed in claim 3, wherein the controller host comprises a programmable logic element and a controlling unit, the programmable logic element is used for receiving the induced voltage signal from the comparator and transmitting the induced voltage signal to the controlling unit for providing the controlling unit to obtain actual coordinate positions of the two opposite sides of the printing material by using all the changes of the induced voltage signal, and to calculate boundary positions and width of the printing material.

5. The detecting method for printing material boundary of the large UV inkjet printer as claimed in claim 4, wherein the programmable logic element is a field programmable gate array.

6. The detecting method for printing material boundary of the large UV inkjet printer as claimed in claim 1, wherein the sensing device is disposed on an inkjet module installed on the large UV inkjet printer.

* * * * *